US009372027B2

(12) United States Patent
Yoo et al.

(10) Patent No.: US 9,372,027 B2
(45) Date of Patent: Jun. 21, 2016

(54) REFRIGERATOR AND SHELF ASSEMBLY FOR A REFRIGERATOR

(71) Applicant: LG Electronics Inc., Seoul (KR)

(72) Inventors: Daehyun Yoo, Seoul (KR); Jaeyoul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 78 days.

(21) Appl. No.: 14/462,900

(22) Filed: Aug. 19, 2014

(65) Prior Publication Data

US 2015/0076985 A1 Mar. 19, 2015

(30) Foreign Application Priority Data

Sep. 13, 2013 (KR) ..... 10-2013-0110453

(51) Int. Cl.

| | |
|---|---|
| ***A47B 96/04*** | (2006.01) |
| ***F25D 25/02*** | (2006.01) |
| ***F25D 11/00*** | (2006.01) |
| ***F25D 23/00*** | (2006.01) |
| *F25D 25/04* | (2006.01) |

(52) U.S. Cl.

CPC ..... *F25D 25/024* (2013.01); *F25D 11/00* (2013.01); *F25D 23/00* (2013.01); *F25D 25/02* (2013.01); *F25D 25/04* (2013.01)

(58) Field of Classification Search

CPC ..... F25D 25/02; F25D 25/04

USPC ..... 312/408

See application file for complete search history.

(56) References Cited

U.S. PATENT DOCUMENTS

| | | | | |
|---|---|---|---|---|
| 2,998,290 | A | 8/1961 | Sharpe | |
| 3,316,044 | A * | 4/1967 | Carbary | 312/408 |
| 3,516,369 | A * | 6/1970 | Bidak et al. | 108/138 |
| 3,982,801 | A | 9/1976 | Heidorn et al. | |
| 4,217,010 | A * | 8/1980 | Webb | 312/407 |
| 4,625,657 | A * | 12/1986 | Little et al. | 108/93 |
| 5,199,778 | A * | 4/1993 | Aoki et al. | 312/408 |

(Continued)

FOREIGN PATENT DOCUMENTS

| | | |
|---|---|---|
| DE | 20 2007 013 356 U1 | 10/2008 |
| WO | WO 03/095912 A1 | 11/2003 |

OTHER PUBLICATIONS

European Search Report issued in Application No. 14184578.4 dated Apr. 24, 2015.

*Primary Examiner* — Daniel J Troy
*Assistant Examiner* — Kimberley S Wright
(74) *Attorney, Agent, or Firm* — Ked & Associates LLP

(57) ABSTRACT

A refrigerator and a shelf assembly for a refrigerator are provided. The refrigerator may include a cabinet provided with a storage compartment, and a shelf assembly mounted in the storage compartment to adjust a height of a shelf. The shelf assembly may include a shelf mounted to vertically move in the storage compartment, a frame mounted to be vertically movable and support the shelf, at least one rotation gear provided at each of opposite sides of the frame, a pair of guide brackets provided at the opposite sides of the frame, a pair of sliders moved within the pair of guide brackets by the rotation gears, an exterior of each of the pair of sliders being provided with at least one protrusion, a power transmission to transmit rotatory power of the rotation gears to the pair of sliders, at least one guide groove formed on each of opposite inner surfaces of the storage compartment to guide movement of the protrusions, and a rotation device to rotate the rotation gears.

20 Claims, 11 Drawing Sheets

(56) References Cited

U.S. PATENT DOCUMENTS

| | | | | |
|---|---|---|---|---|
| 5,913,584 | A * | 6/1999 | Swindell et al. | 312/408 |
| 6,065,821 | A * | 5/2000 | Anderson et al. | 312/408 |
| 6,363,738 | B2 * | 4/2002 | Nakajima et al. | 62/440 |
| 8,047,623 | B2 * | 11/2011 | Kang et al. | 312/408 |
| 8,100,488 | B2 * | 1/2012 | Eisele et al. | 312/408 |
| 8,172,347 | B2 * | 5/2012 | Lim et al. | 312/408 |
| 8,215,732 | B2 * | 7/2012 | Kim | 312/408 |
| 8,342,619 | B2 * | 1/2013 | Seo et al. | 312/405.1 |
| 8,556,093 | B2 * | 10/2013 | Davis et al. | 211/187 |
| 9,103,581 | B2 * | 8/2015 | Babinski et al. | |
| 9,243,839 | B2 * | 1/2016 | Kim | F25D 25/024 |
| 2007/0096610 | A1 * | 5/2007 | Filho et al. | 312/408 |
| 2007/0176528 | A1 * | 8/2007 | Lee et al. | 312/408 |
| 2008/0203041 | A1 * | 8/2008 | Lim et al. | 211/119.003 |
| 2008/0251483 | A1 * | 10/2008 | Davis et al. | 211/187 |
| 2009/0121600 | A1 * | 5/2009 | Eisele et al. | 312/408 |
| 2009/0308098 | A1 | 12/2009 | An et al. | |
| 2010/0066227 | A1 * | 3/2010 | Ramm et al. | 312/408 |
| 2010/0176703 | A1 * | 7/2010 | Kim | 312/408 |
| 2011/0031863 | A1 * | 2/2011 | Benitsch et al. | 312/408 |
| 2013/0081421 | A1 | 4/2013 | Kwon et al. | |
| 2013/0327073 | A1 * | 12/2013 | Lee et al. | 62/131 |
| 2013/0342095 | A1 * | 12/2013 | Choo et al. | 312/405 |
| 2014/0001943 | A1 * | 1/2014 | Kim et al. | 312/404 |
| 2014/0077679 | A1 * | 3/2014 | Lee et al. | 312/404 |
| 2014/0132145 | A1 * | 5/2014 | Lee et al. | 312/405 |
| 2014/0252938 | A1 * | 9/2014 | Kim et al. | 312/405.1 |
| 2014/0285082 | A1 * | 9/2014 | Choi et al. | 312/404 |
| 2015/0276304 | A1 * | 10/2015 | Choo et al. | |

* cited by examiner

REFRIGERATOR AND SHELF ASSEMBLY FOR A REFRIGERATOR

CROSS-REFERENCE TO RELATED APPLICATION(S)

Pursuant to 35 U.S.C. §119(a), this application claims priority to Korean Patent Application No. 10-2013-0110453, filed in Korea on Sep. 13, 2013, which is hereby incorporated by reference as if fully set forth herein.

BACKGROUND

1. Field

A refrigerator and a shelf assembly for a refrigerator are disclosed herein.

2. Background

Generally, a refrigerator is an appliance for storing food, beverages, or other items in a frozen or refrigerated state within a storage compartment by discharging, into the storage compartment, cold air generated through a refrigeration cycle formed by a compressor, a condenser, an expansion valve, and an evaporator. The refrigerator generally may include in a cabinet a freezer compartment for storage of food, beverages, or other items in a frozen state, and a fresh food compartment for storage of food, beverages, or other items at a low temperature. A Kimchi refrigerator, which stores food, such as Kimchi or vegetables, in a fresh state, is another form of refrigerator.

At least one of a plurality of doors installed at a refrigerator may be connected to a side of the cabinet by a hinge to open or close a front of the cabinet through pivotal movement thereof. In addition to such a door that pivots about a hinge, a drawer type door may also be employed. The drawer type door may include a drawer, and a door mounted to a front surface of the drawer to be pulled out or retracted in a forward or rearward direction together with the drawer.

Generally, storage compartments of a refrigerator, namely, a freezer compartment and a fresh food compartment, may be provided with a plurality of shelves that horizontally divide the freezer compartment and the fresh food compartment into sections in order to accommodate items of various sizes and enhance space utilization of the storage compartments. As items of various sizes need to be placed on the shelves, the shelves may be installed to be vertically movable in the freezer compartment and fresh food compartment. That is, the shelves may be slidably mounted on a plurality of support ribs formed on or at left and right side surfaces of the freezer compartment and fresh food compartment, or may be mounted on a mount rail having a plurality of vertically formed holes by mounting a pair of cantilevers coupled to the shelves on the mount rail.

In conventional cases, however, when a user desires to adjust a height of a mounted shelf, the user needs to remove all items from the shelf, separate the shelf from the support ribs or mount rail, and then install the shelf at another position. Accordingly, adjusting the height of a shelf is difficult and inconvenient.

Hence, a shelf assembly supported by a worm gear that allows a user to rotate the shelves has been proposed. However, manipulating this assembly requires the user to apply a great force, and reliability of adjustment of the height of the shelves and durability may be degraded.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. Wherever possible, the same reference numbers will be used throughout the drawings to refer to the same or like parts, and repetitive disclosure has been omitted.

Figure 1:
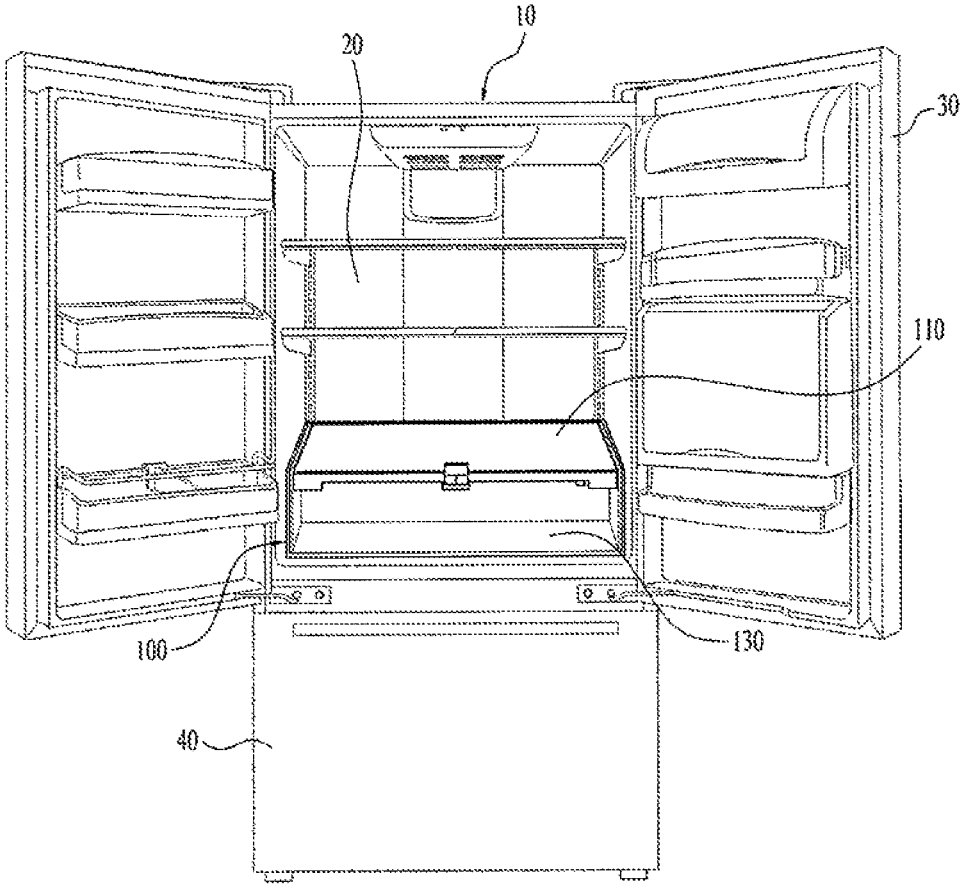
FIG. 1 is a perspective view of a bottom freezer type refrigerator with a shelf assembly according to an embodiment.

FIG. 1 is a perspective view of a bottom freezer type refrigerator with a shelf assembly according to an embodiment. The refrigerator according to this embodiment may include a cabinet 10 provided therein with a storage compartment and a shelf assembly 100 mounted to the storage compartment and configured to adjust a height of a shelf 110.

The refrigerator of FIG. 1 is a bottom freezer type refrigerator in which a fresh food compartment 20 is disposed at an upper portion of the cabinet 10, and a freezer compartment is disposed at a lower portion of the cabinet 10. However, embodiments are also applicable to any type of refrigerator that allows the shelf assembly 100 to be mounted to or in a storage compartment, such as the fresh food compartment or the freezer compartment.

Examples or other types of refrigerators include a side-by-side type refrigerator and a top mounting type refrigerator. In the side-by-side type refrigerator, the freezer compartment and the fresh food compartment are arranged side by side. In the top mounting type refrigerator, the freezer compartment is disposed above the fresh food compartment. Embodiments are also applicable to a refrigerator provided only with a fresh food compartment or freezer compartment allowing the shelf assembly to be mounted therein.

The fresh food compartment 20 provided to or at the upper portion of the cabinet 10 may be opened and closed by a pair of fresh food compartment doors 30 pivotably mounted thereto. The freezer compartment provided to or at the lower portion of the cabinet 10 may be opened and closed by a freezer compartment door 40, which may be a drawer type door.

In the fresh food compartment 20, the shelf assembly 110 having a vertically movable shelf 110 may be mounted to a lower portion of the fresh food compartment 20, and another shelf may be arranged on the shelf assembly 110. The shelf mounted on the shelf assembly 100 may be supported by a cantilever or a shelf support rib, as shown in FIG. 1.

Figure 2:
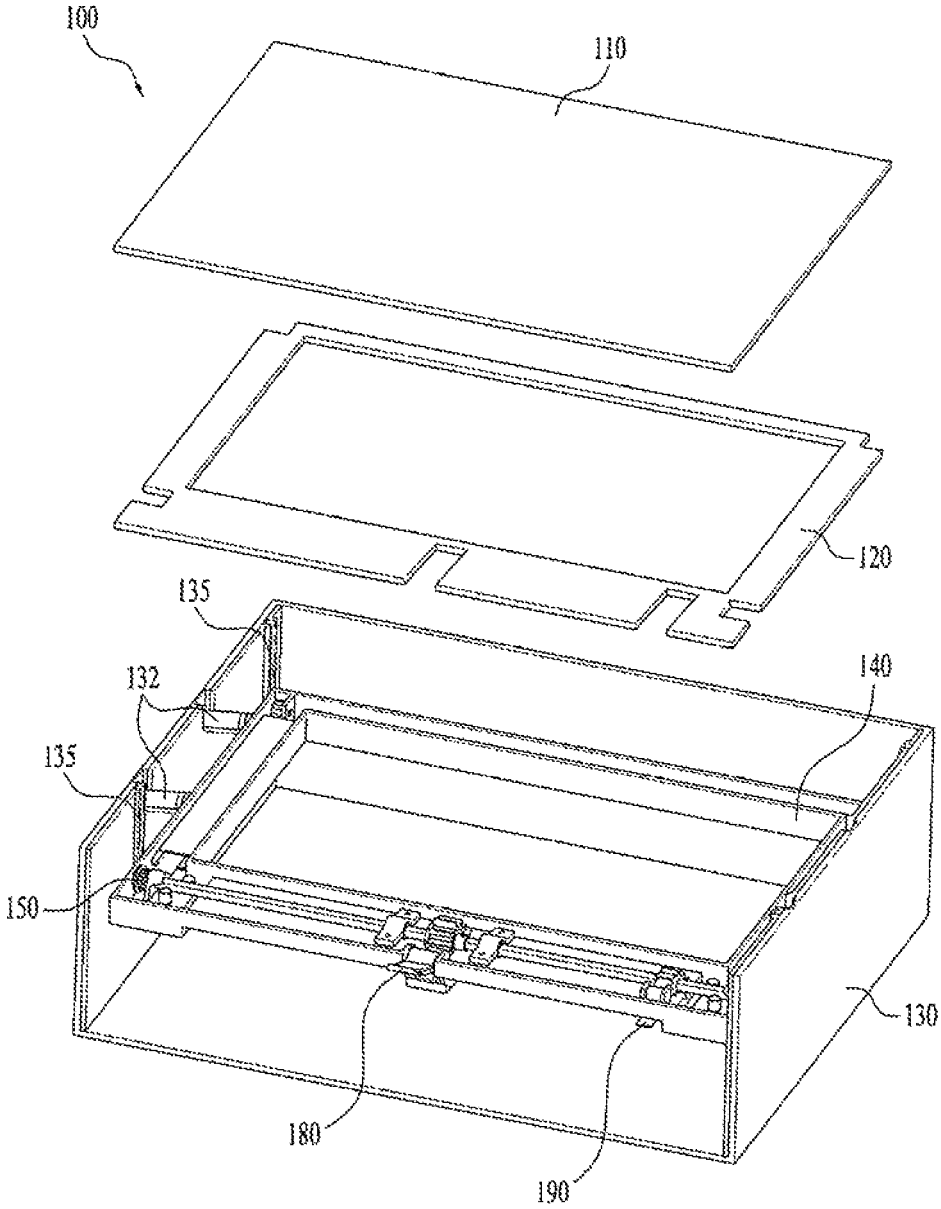
FIG. 2 is a perspective view of a shelf assembly according to an embodiment.
Figure 3:
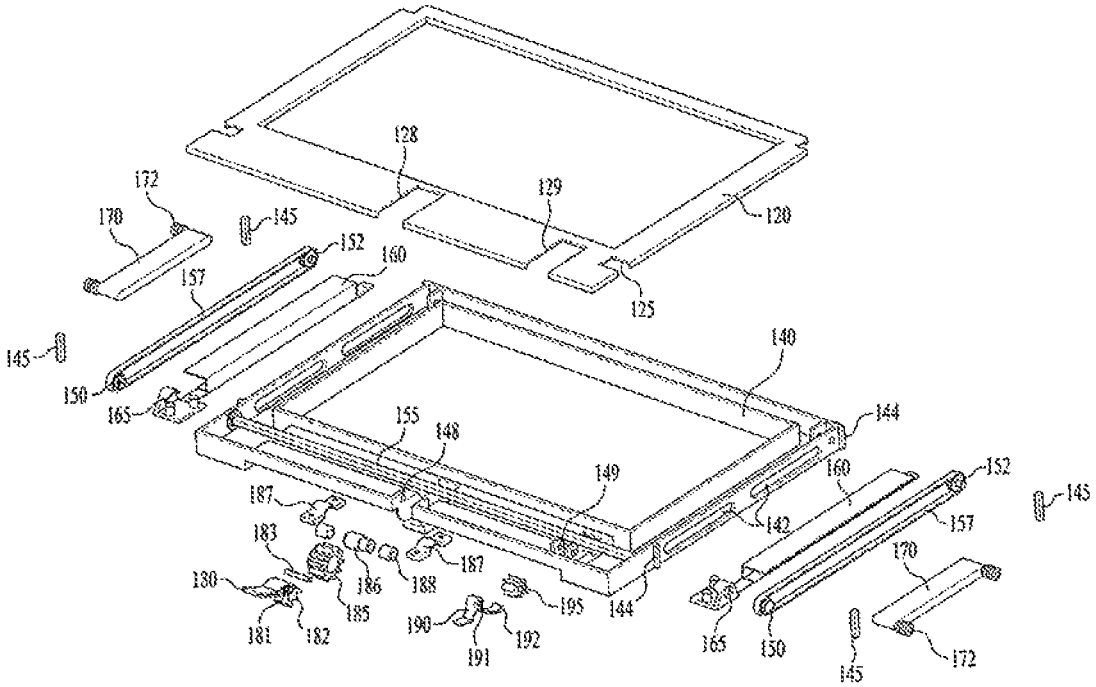
FIG. 3 is an exploded perspective view of the shelf assembly of FIG. 2.
Figure 4:
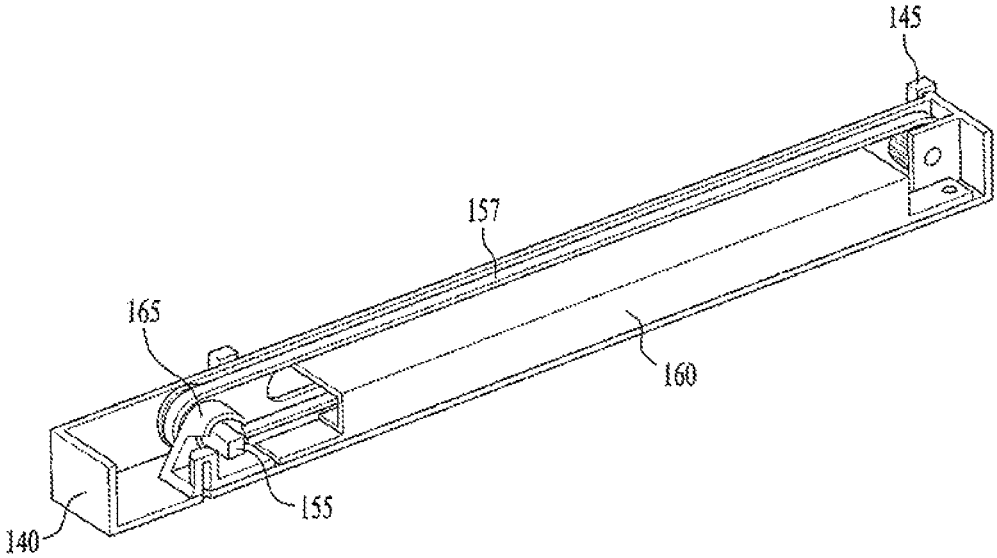
FIG. 4 is a partially cutaway perspective view of a belt mounted to a rotation gear of the shelf assembly of FIG. 2.

FIG. 2 is a perspective view of a shelf assembly according to an embodiment. FIG. 3 is an exploded perspective view of the shelf assembly of FIG. 2. FIG. 4 is a partially cutaway perspective view of a belt mounted to a rotation gear of the shelf assembly of FIG. 2. For simplicity of illustration, the belt shown in FIGS. 3 and 4 is not shown in FIG. 2.

The shelf assembly 100 may include a shelf 110 mounted in the storage compartment so as to be vertically movable, a frame 140 configured to vertically move and support the shelf 110, a pair of rotation gears 150 provided to or at both sides of the frame 140, a pair of guide brackets 160 provided to or at both sides of the frame 140, a pair of sliders 170 moved back and forth in the pair of guide brackets 160 by the pair of rotation gears 150, a power transmission configured to transfer rotatory power of the pair of rotation gears 150 to the pair of sliders 170 to horizontally move the pair of sliders 170, at least one pair of guide grooves 132 provided to or at an inner surface of the storage compartment to guide movement of at least one pair of protrusions provided to or at outer side surfaces of the pair of sliders 170, and a rotation device to rotate the pair of rotation gears 150. The at least one pair of guide grooves 132 may be slanted.

The shelf 110 may be a quadrangular plate configured to accommodate objects, such as food placed thereon. The accommodated objects may also be stored below the shelf 110, and the shelf 110 may be formed of a transparent or semi-transparent plastic to allow the objects stored below the shelf 110 to be seen therethrough. The frame 140, which may support and vertically move together with the shelf 110, may be disposed along or at an edge of the shelf 110.

Several components to implement an operational mechanism of the shelf assembly may be mounted to or on the frame 140. That is, the frame 140 may include a concave portion having an open top. The pair of rotation gears 150, the pair of guide brackets 160, the pair of sliders 170, the power transmission, and the rotation device may be mounted to or in the concave portion.

The frame 140 may be further provided with a frame cover 120 having a plurality of grooves formed therein so as not to interfere with components mounted to or in the concave portion. An overall shape of the frame cover 120 may correspond to a shape of the concave portion of the frame 140. A portion of the frame cover 120 that overlaps components, such as the pair of rotation gears 150 and the rotation device, may be provided with a groove. The frame cover 120 may not only serve to protect components mounted to or in the frame 140, but may also cover complex components to prevent the complex components from being externally exposed through the transparent or semi-transparent shelf 110.

The pair of rotation gears 150 may be rotatably mounted to front portions of both sides of the frame 140. A rotation shaft of the pair of rotation gears 150 may be laterally mounted to ends of both sides of a front of the frame 140. That is, a rotation gear mounting portion 165 may be separately provided to or in the concave portion of the frame 140.

The pair of guide brackets 160 may be mounted to or at both sides of the frame 140. Each of the pair of guide brackets 160 may be disposed on or at a back of a corresponding one of the pair of rotation gears 150. As the pair of rotation gears 150 is disposed in front of the guide brackets 160, the rotation gear mounting portion 165 may be integrated with the pair of guide brackets 160 and mounted to the frame 140.

The pair of sliders 170 may be inserted into and slidably mounted to the pair of guide brackets 160. The pair of sliders 170 may be allowed to slide within the pair of guide brackets 160 by the pair of rotation gears 150. That is, the pair of guide brackets 160 and the pair of sliders 170 may be formed of a material producing low friction therebetween. Each of the guide brackets 160 may have a "ㄷ"-shaped cross section so as to support both an upper portion and a lower portion of a corresponding one of the pair of sliders 170.

The pair of sliders 170 may be moved back and forth by the pair of rotation gears 150. With this embodiment, belts 157 and gear type pulleys may be used as the power transmission to transmit rotatory power of the pair of rotation gears 150 to the pair of sliders 170 to horizontally move the sliders 170. In addition to the pair of rotation gears 150 serving as drive gears, driven gears 152 connected to the pair of rotation gears 150 by the belt 157 may further be provided.

Like a timing belt, an inner surface of belt 157 installed between the rotation gear 150 and the driven gear 152 may be provided with grooves equally spaced from each other to correspond to grooves of the gears. The rotation gear 150 and the belt 157 do not rotate only in one direction. Rather, they rotate back and forth within a predetermined range. Accordingly, not all of the inner surface of the belt 157 may be provided with grooves. As the belts 157 rotate back and forth by being engaged with lower surfaces of the pair of sliders 170, the pair of sliders 170 may be moved back and forth. The belts 157 may be attached to the lower surfaces of the pair of sliders 170 by an adhesive, or may be coupled to the lower surfaces by a coupling member, such as a screw.

A pair of protrusions may be provided to or at an exterior of each of the pair of sliders 170. The pair of protrusions may include at least one pair of rollers 172 rotatably mounted to an exterior of the pair of sliders 170.

Rotation shafts of the rollers 172 may be horizontally mounted to the exterior of the pair of sliders 170. Each of the pair of sliders 170 may be provided with two rollers 172.

The at least one pair of rollers 172 may be inserted into at least one pair of guide grooves 132 (see FIG. 2) provided an inner side surfaces of the storage compartment, such that movement of the rollers 172 may be guided by the grooves. The pair of guide grooves 132 may be slanted.

While the guide grooves 132 are illustrated as being formed on inner surface of a case 130 of the shelf assembly 100 in FIG. 2, the guide grooves 132 may be formed on both sides of the fresh food compartment 20, which is a storage compartment, in the same pattern. Each of the guide grooves 132 formed on both side surfaces of the fresh food compartment 20 may be provided with a horizontal portion in addition to an inclined portion and a vertical portion to allow the rollers 172 to be inserted thereinto with the shelf assembly 100 assembled.

The case 130 may be a box formed in the shape of a rectangular parallelepiped having an open top and front. When the shelf assembly 100 includes the case 130, the frame 140 connected with the shelf 110 and mounted to the case 130 may be more conveniently seated in the fresh food compartment 20.

As shown in FIG. 2, the two pairs of guide grooves 132 formed on the inner surface of the case 130 may be provided with inclined portions and vertical portions. Thereby, the at least one pair of rollers 172 may be easily inserted and installed through the vertical portions.

As shown in FIGS. 2 and 3, the pair of rotation gears 150 may be connected to each other to be rotated together by a rotation bar 155 rotatably mounted to the concave portion of the frame 14. A cross section of the rotation bar 155 may be formed in a quadrangular shape so as to be rotated by, for example, a handle 180, which will be described hereinbelow. In addition, the rotation bar 155 may be rotatably mounted to the concave portion of the frame 140 by a bearing 188 having a quadrangular hole and a bracket 187 having a screw fastening hole.

The pair of rotation gear 150 may be mounted to the rotation gear mounting portion 165. The rotation bar 155 may be inserted into a quadrangular groove formed at an inner side of the rotation gear 150. In addition, as the rotation bar 155 extends laterally and is subjected to torque applied by the handle 180, which will be described hereinbelow, a middle portion of the rotation bar 155 needs to be securely and rotatably fixed. Accordingly, the middle portion of the rotation bar 155 may be mounted to the concave portion of the frame 140 by a pair of the bearings 188 and a pair of the brackets 187.

In this embodiment, the rotation device to rotate the pair of rotation gears 150 may include the rotation bar 155, a unidirectional rotation gear 185 mounted to the rotation bar 155, and the handle 180 rotatably mounted to the frame 140 and provided at a rear end thereof with an arc-shaped gear 182 engaged with the unidirectional rotation gear 185 to rotate the unidirectional rotation gear 185.

Figure 5A:
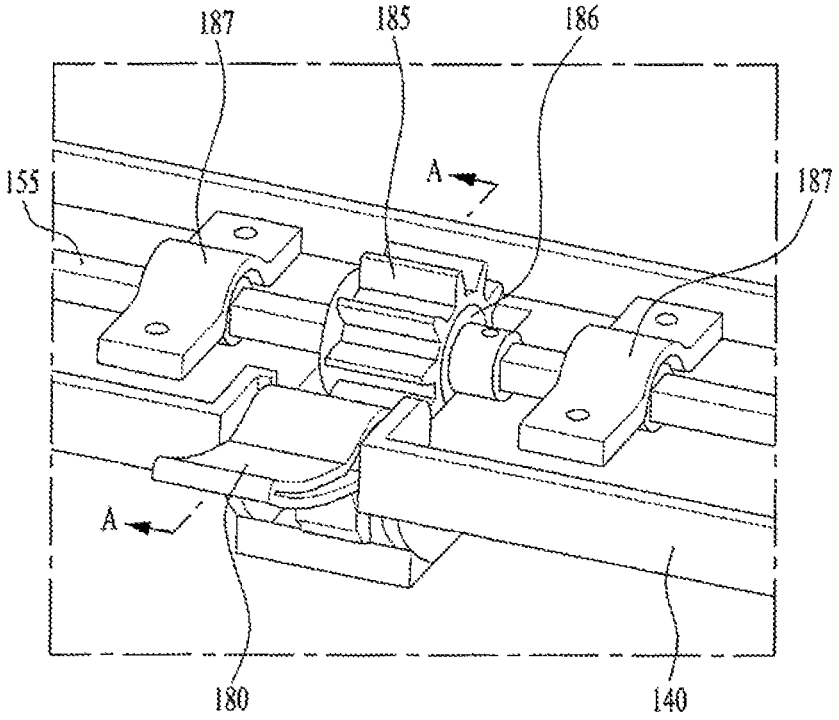
FIGS. 5A and 5B show an enlarged perspective view and a cross-sectional view of a handle of the shelf assembly of FIG. 2.
Figure 5B:
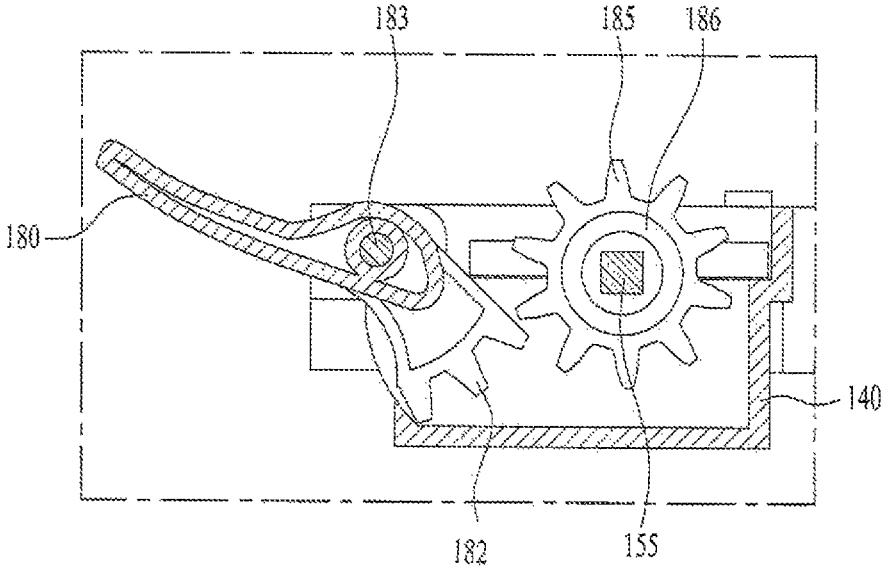

FIGS. 5A-5B show an enlarged perspective view and a cross-sectional view of a handle of the shelf assembly of FIG. 2. A front central portion of the frame 140 may be provided with a recessed portion 148 to which the handle 180 and the unidirectional rotation gear 185 may be mounted. The handle 180 may be mounted by inserting a pivot pin 183 into a pin hole (not shown) formed in the recessed portion 148 and a pivot hole 181 formed in a central portion of the handle 180. The handle 180 may extend from the pivot hole 181 by a predetermined length to protrude from the recessed portion 148 such that a front end of the handle 180 may be easily pushed by a finger.

The arc-shaped gear 182 may be formed at an end of the handle 180 to extend from an opposite side of the pivot hole 181 so as to be selectively engaged with the unidirectional rotation gear 185. The unidirectional rotation gear 185 may rotate together with the rotation bar 155 when rotated in a first direction by the arc-shaped gear 182 of the handle 180. On the other hand, when the unidirectional rotation gear 185 is rotated in a second opposite direction, it may run idle without rotation of the rotation bar 155. That is, the unidirectional rotation gear 185 may be mounted to the rotation bar 155 by a clutch bearing 186 disposed between the unidirectional rotation gear 185 and the rotation bar 155. Referring to FIG. 5B, rotatory power of the unidirectional rotation gear 185 produced clockwise may be transmitted to the rotation bar 155 by the clutch bearing 1868, while the rotatory power produced counterclockwise may not be transmitted to the rotation bar 155.

Accordingly, the pair of rotation gears 150 connected to both ends of the rotation bar 155 may be rotated simultaneously by a predetermined angle when the handle 180 rotates the unidirectional rotation gear 185 in the first direction, and be returned to an original position thereof by rotating in the second opposite direction. Subsequently, by rotating the handle 180 again, the pair of rotation gears 150 may be rotated by another predetermined angle.

To ensure smooth return of the handle 180, an elastic member (not shown) may be provided between the handle 180 and the frame 140. The elastic member may be, for example, a torsion spring installed at the pivot shaft of the handle 180, or may be a compression spring or a tension spring placed between and connected to one side of the arc-shaped gear 182 and the frame 140.

When the user rotates the pair of rotation gears 150 by a predetermined angle by rotating the handle 180, the pair of sliders 170 may be moved forward by a predetermined distance by the belt 157. The rollers 172 provided to the exterior of the pair of sliders 170 may rise by being guided by the guide grooves 132. Thereby, the frame 140 and the shelf 110 mounted thereto may be raised to a predetermined height.

Figure 6:
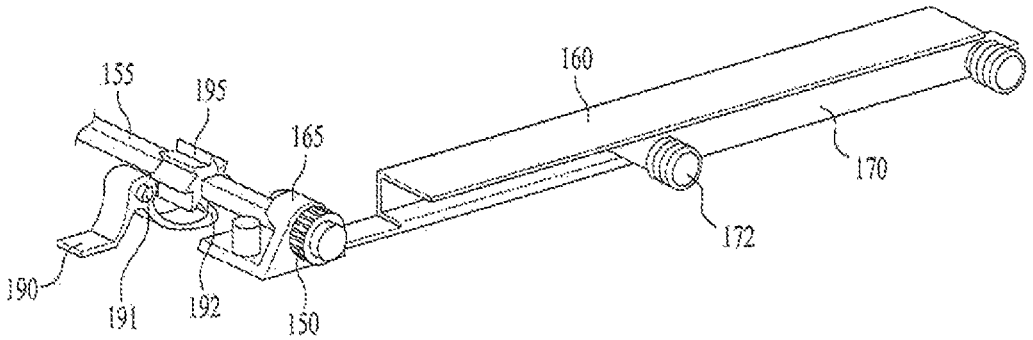
FIG. 6 is a partial perspective view of a coupling between a lever mounted to a side of a frame and a stopper gear mounted to a side of a rotation bar according to an embodiment.

FIG. 6 is a partial perspective view of a coupling between a lever mounted to a side of a frame and a stopper gear mounted to a side of a rotation bar according to an embodiment. As shown in FIGS. 2, 3 and 6, the shelf assembly 100 may further include a stopper gear 195 mounted to one side of the rotation bar 155 to rotate together with the rotation bar, and a lever 190 rotatably mounted to one side of the frame 140 and engaged with the stopper gear 195 to prevent rotation of the stopper gear 195 in one direction.

The handle 180, which may be a rotation device provided to or at the front central portion of the frame 140, may raise the frame 140, but cannot resist downward movement of the frame 140 due to gravity. As the unidirectional rotation gear 185 is mounted to the rotation bar 155 by the clutch bearing 186, it cannot stop counterclockwise rotation of the rotation bar 155 with respect to FIG. 5B.

The stopper gear 195, which may rotate together with the rotation bar 155 in normal and reverse directions, may be mounted to the rotation bar 155, and the lever 190 engaged with the stopper gear 195 to allow the stopper gear 195 to rotate only in the first direction may be mounted to a front of the stopper gear 195. Thereby, rotation of the rotation bar 155 in the second direction may be selectively prevented. That is, one end of the lever 190 may be provided with a locking protrusion 192 selectively engaged with the stopper gear 195.

As shown in FIG. 3, a pivot shaft 191 of the lever 190 may be mounted to a lever mounting portion 149 provided to one side of the front of the frame 140, and the front end of the lever 190 may extend downward of the frame 140. The locking protrusion 192 may be formed at a rear end of the pivot shaft 191 and extend downward in a rearward direction. The locking protrusion 192 may be formed of a material which is elastically deformable to a predetermined extent.

An outer circumferential surface of the stopper gear 195 may be provided with a plurality of teeth inclined by a predetermined angle with respect to a radial direction of the stopper gear 195. Thereby, rotation of the stopper gear 195 in the first direction may be restricted by the locking protrusion 192, but the stopper gear 195 may rotate in the second opposite direction without being restricted by the locking protrusion 192 as the locking protrusion 192 is elastically deformed.

When the user desires to lower the frame 140 and the shelf 110 to a predetermined height after raising the same by pushing the handle 180 several times, the user may lift the lever 190, thereby allowing the rotation bar 155 and the pair of rotation gears 150 to rotate in the second opposite direction by gravity. Once the lever 190 is lifted, the stopper gear 195 may rotate as the locking protrusion 192 is released from the stopper gear 195. As rotation of the stopper gear 195 is not restricted, the frame 140 and the shelf 110 may be lowered as the rotation bar 155 and the rotation gears 150 rotate by gravity.

At this time, the rotation angle by which the pair of rotation gears 150 rotate when the lever 190 is lifted once may be determined by a space between the teeth of the stopper gear 195. If the lever 190 is held lifted, the pair of rotation gears 150 may continue to rotate, and the frame 140 and the shelf 110 may be lowered until the rollers 172 of the pair of sliders 170 are supported by lowermost ends of the guide grooves 132.

When the frame 140 is raised and lowered by operation of the handle 180 and the lever 190, it may be inclined as the guide grooves 132 are inclined. To prevent the frame 140 from being inclined, guide protrusions 145 may be provided at both sides of the frame 140, and guide grooves 135, into which the guide protrusions 145 may be slidably inserted, may be vertically formed on both inner side surfaces of the storage compartment or the case 130, as shown in FIGS. 2 and 3. Thereby, vertical movement of the frame 140 may be guided.

As shown in FIG. 3, a pair of coupling protrusions 144 may be formed at both sides of the frame 140. The guide protrusions 145 may be press-fitted into the coupling protrusions 144 or joined to the coupling protrusions 144 by, for example, an adhesive or a screw.

As the guide protrusions 145 are inserted into the guide grooves 135 to slide therein, they may be formed, as members separate from the frame 140, of a material producing lower friction therebetween. The guide protrusions 145 may be inserted into the guide grooves 135 to support the frame 140 such that the frame 140 does not move back and forth.

Accordingly, when the rollers 172 of the pair of sliders 170 inserted into the inclined guide grooves 132 are guided, horizontal movement of the rollers 172 may only cause vertical movement of the frame 140. Thereby, even though the pair of sliders 170 move horizontally, the frame 140 may move vertically.

Figure 7:
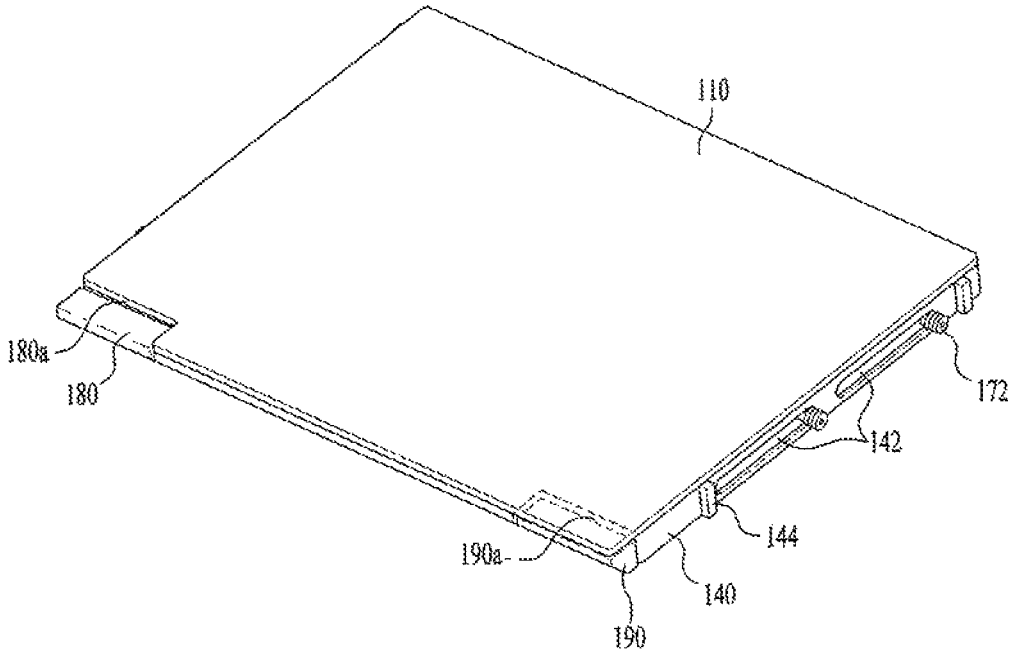
FIG. 7 is a perspective view of a frame and shelves of a shelf assembly according to another embodiment.
Figure 8:
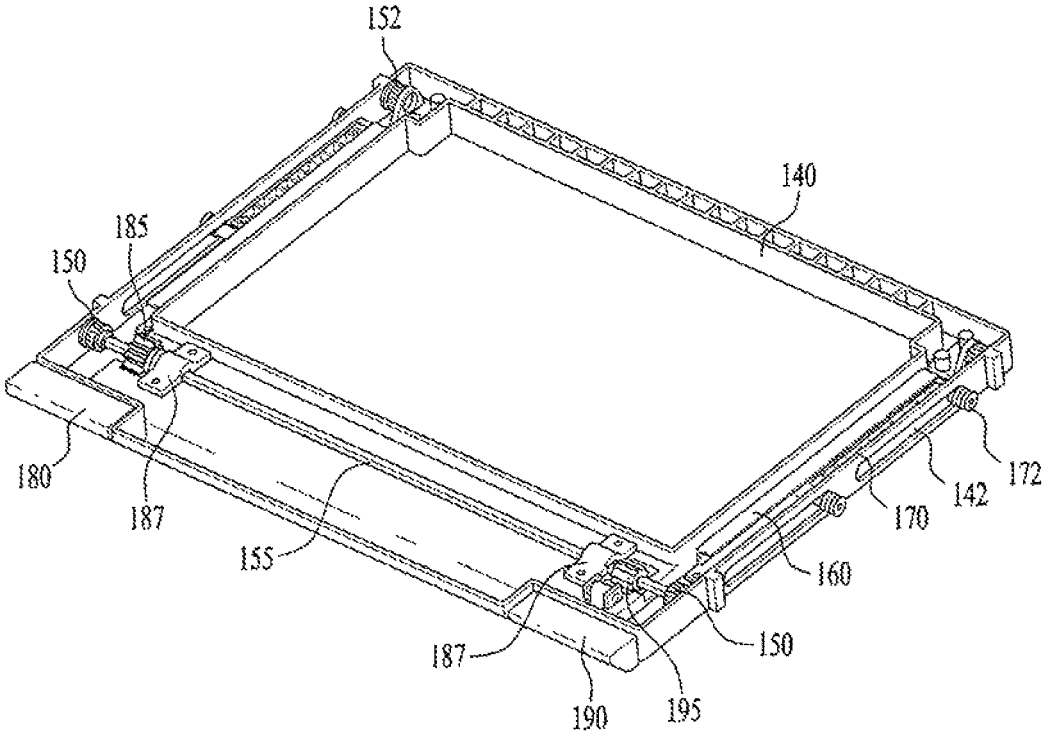
FIG. 8 is a perspective view of the shelf assembly of FIG. 7, with the shelves removed.

Hereinafter, structure and operation of a shelf assembly according to another embodiment will be described with reference to FIGS. 7 to 10. Unlike the previous embodiment, the handle and the lever of this embodiment may be arranged not to protrude from the frame and the shelf. As shown in FIGS. 7 and 8, the handle 180 may be mounted to a front left corner of the frame 140, and the unidirectional rotation gear 185 may be installed at a back of the handle 180.

A cutaway 180*a* having a shape corresponding to that of the handle 180 may be formed at a front left corner of the shelf 110 to allow the handle 180 to be exposed without being covered by the shelf 110, as shown in FIG. 7. Thereby, a user may push the handle 180 downward.

Figure 9:
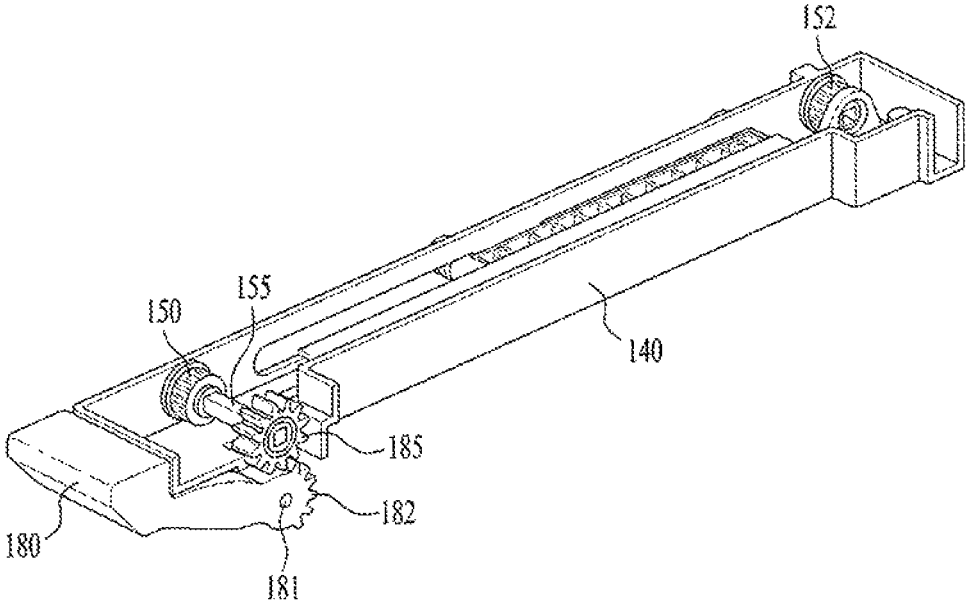
FIG. 9 is a partial perspective view illustrating operation of a handle of FIG. 8.

Unlike the previous embodiment, the handle 180 of this embodiment may be mounted to a lower portion of the frame 140. As shown in FIG. 9, the pivot shaft 181 of the handle 180 may be mounted to the lower portion of the frame 140, and a rear end of the pivot shaft 181 may be provided with an arc-shaped gear 182.

The pivot shaft 181 may be arranged closer to the arc-shaped gear 182 than to the handle 180. Accordingly, in rotating the unidirectional rotation gear 185 and the pair of rotation gears 150, the handle 180 may need to be pushed by a relatively long distance, but less force may be required. For simplicity of illustration, the belt 157 installed between the pair of rotation gear 150 and the driven gear 152 is not shown in FIG. 9.

Figure 10:
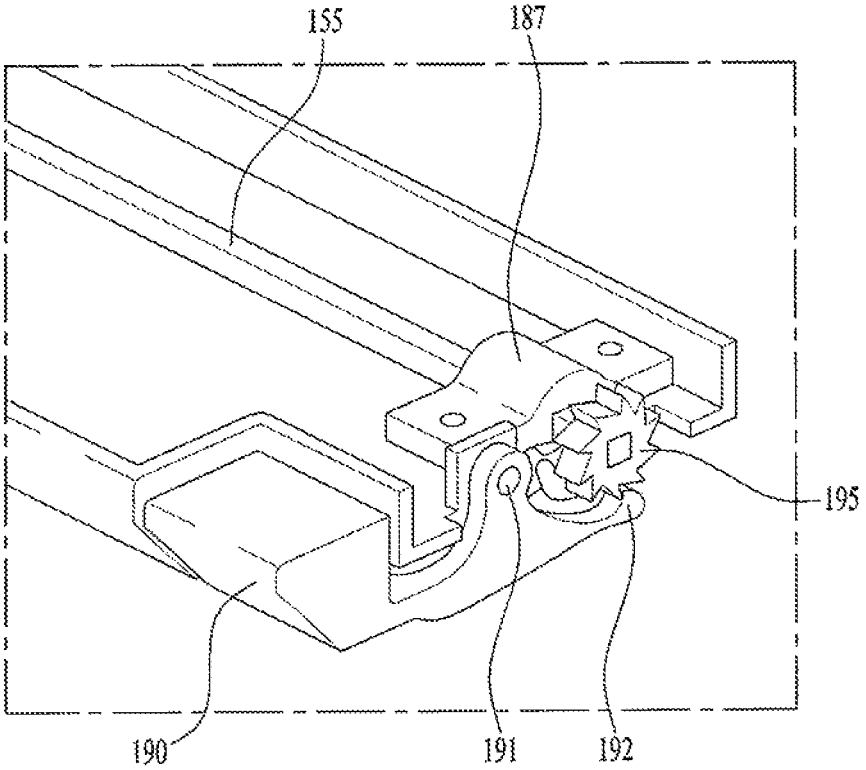
FIG. 10 is a partial perspective view illustrating operation of a lever and stopper gear of FIG. 8.

As shown in FIG. 8, the lever 190 may be mounted to a front right corner of the frame 140. As shown in FIG. 10, details of the lever 190 are the same as those in the previous embodiment, except that the front end of the lever 190 may have a shape corresponding to that of a cutaway 190*a* formed at the front right corner of the frame 140.

Unlike the previous embodiment, bracket 187 may be installed to be adjacent to the stopper gear 195. Another bracket 187 may be installed to be adjacent to the unidirectional rotation gear 185.

In this embodiment, force may be applied to both ends of the rotation bar 155, but not to a central portion of the rotation bar 155. Therefore, portions of the rotation bar 155 near both ends of the rotation bar 155 may be supported by the brackets 187 and bearings.

In this embodiment, gear mounting portion 165 (see FIG. 4) mounted to a front of the guide brackets 160 illustrated in previous embodiment may not be needed. This is because the brackets 187 and bearings may be installed at positions close to the pair of rotation gears 150.

In the shelf assembly 100 of this embodiment, the handle 180 and the lever 190 do not protrude from an outline of the shelf 110 and the frame 140, but form a continuous surface, respectively. Accordingly, compared to the shelf assembly of the previous embodiment having the handle 180 protruding from the shelf, the shelf assembly 100 according to this embodiment may not interfere with the introduction or retrieval of objects.

Figure 11:
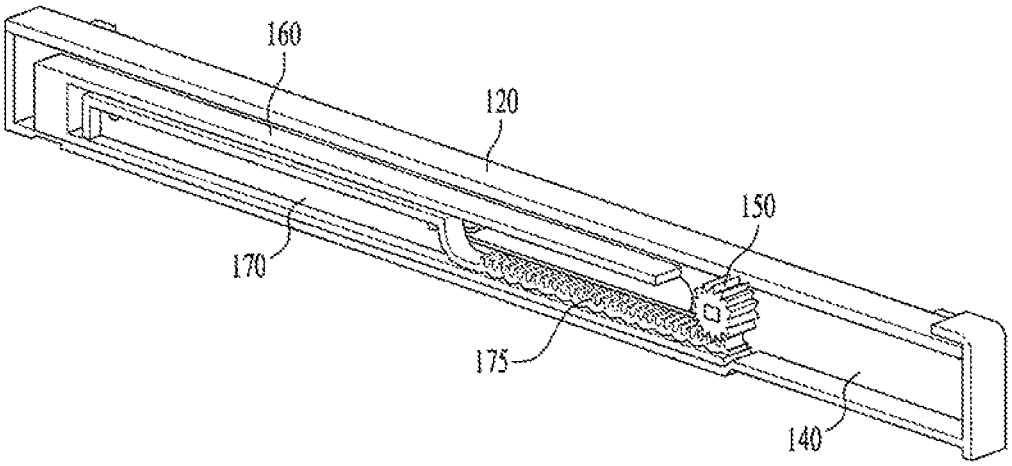
FIG. 11 is a partial perspective view illustrating coupling between a rack of a slider and a rotation gear in a shelf assembly according to another embodiment.

FIG. 11 is a partial cutaway perspective view illustrating coupling between a rack of a slider and a rotation gear in a shelf assembly according to another embodiment. Referring to FIG. 11, the pair of sliders 170 slidably guided by the pair of guide brackets 160, and more particularly, upper surfaces of front portions of the pair of sliders 170 may be provided with a rack 175 or rack teeth. The pair of rotation gears 150 may be pinions engaged with the rack 175 to move the sliders 170 forward by rotating.

As described above, the pair of rotation gears 150 may move the sliders 170 only forward according to unidirectional rotation of a unidirectional rotation gear 185 (see FIG. 9), and when the user lifts the lever 190 (see FIG. 10), the sliders 170 may move backward due to gravity.

In this embodiment, a rack and a pinion are used as the power transmission. Thereby, reliability of power transmission and durability may be higher than in the case in which the belt is used.

Hereinafter, structure and operation of a shelf assembly according to another embodiment will be described with reference to FIGS. 12 to 14B. This embodiment is different from the previous embodiments in that the shelf assembly employs a rotary knob and a worm gear, rather than a handle rotated by being pushed, as a rotation device to rotate the gears.

Figure 12:
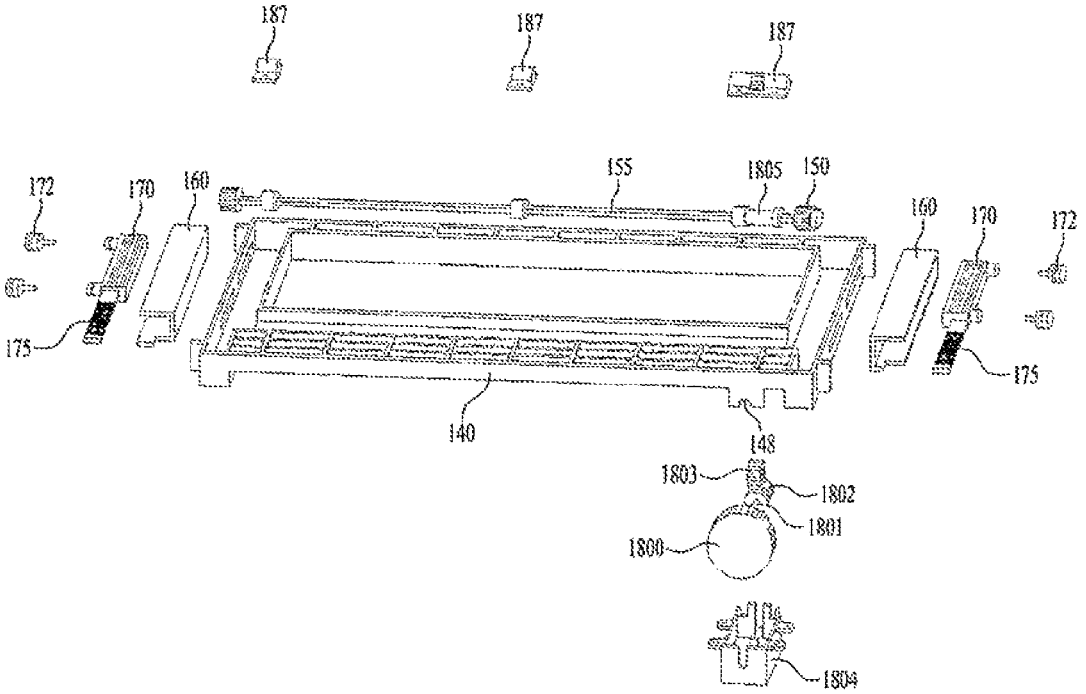
FIG. 12 is an exploded perspective view of a shelf assembly according to another embodiment.
Figure 13:
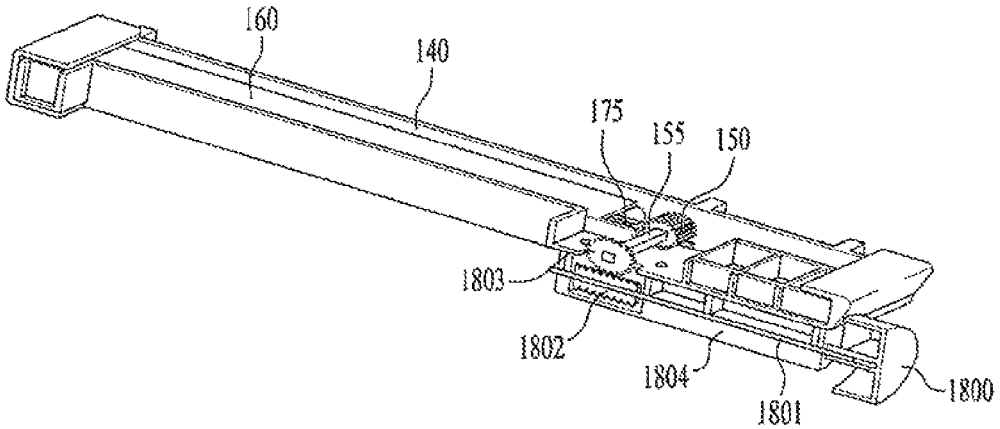
FIG. 13 is a partial cutaway perspective view illustrating movement of a rack of a slider through rotation of a rotation gear according to rotation of a handle of FIG. 12.
Figure 14A:
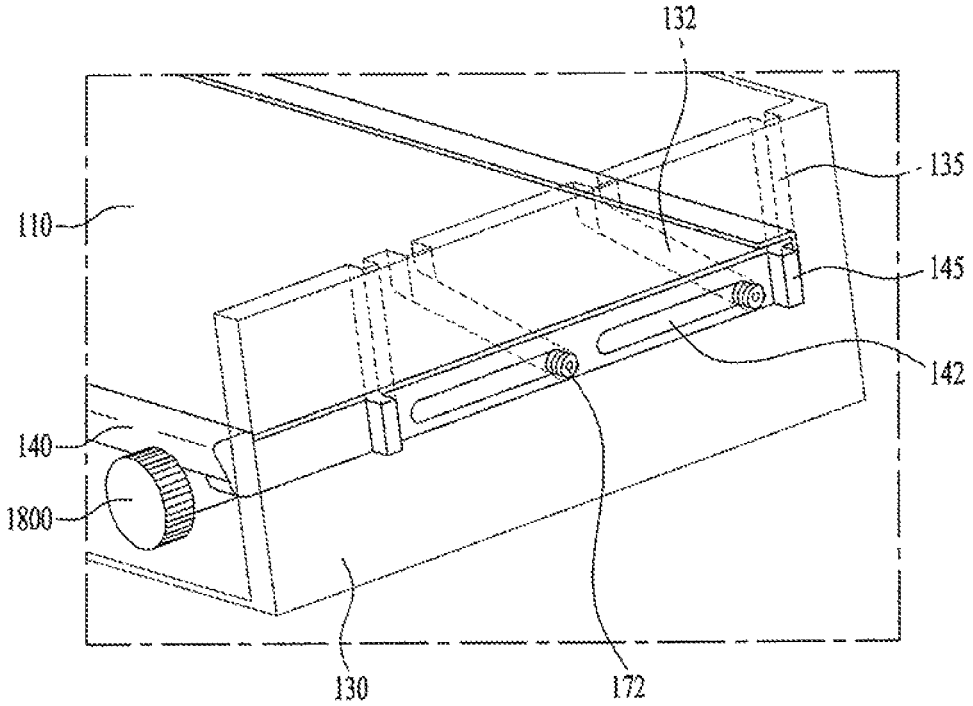
FIGS. 14A-14B are partial perspective views illustrating elevation of shelves and a frame supported by guide grooves of a case according to rotation of the handle of the shelf assembly of FIG. 12.
Figure 14B:
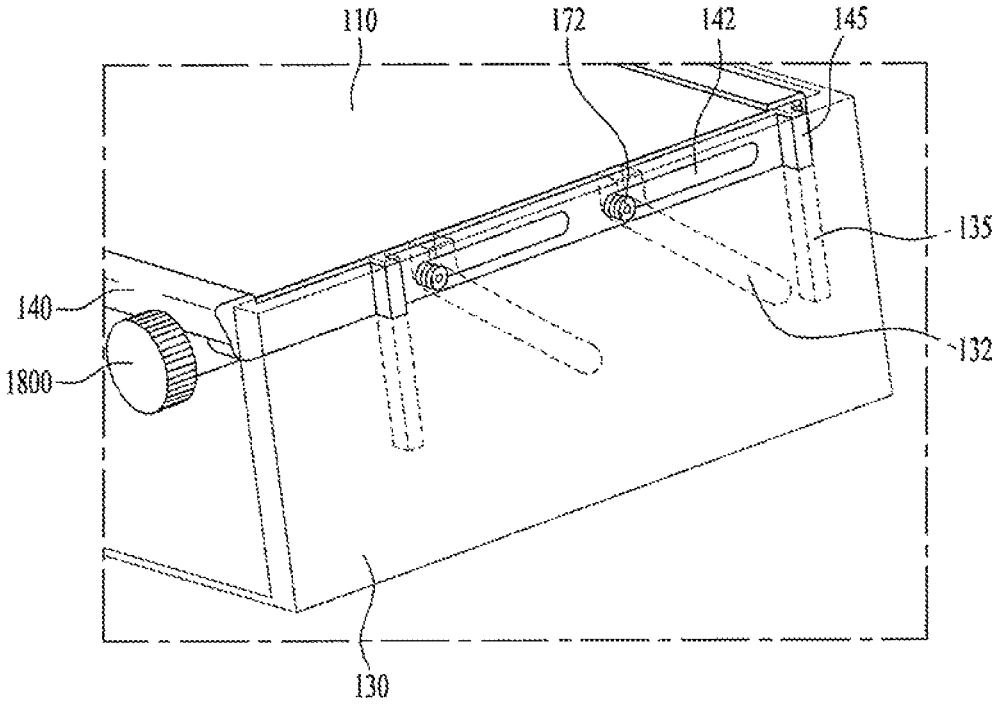

FIG. 12 is an exploded perspective view of a shelf assembly according to another embodiment. FIG. 13 is a partial cutaway perspective view illustrating movement of a rack of a slider through rotation of a rotation gear according to rotation of a handle of FIG. 12. FIGS. 14A-14B are partial perspective views illustrating elevation of shelves and a frame supported by guide grooves of a case according to rotation of the handle of the shelf assembly of FIG. 12.

As shown in FIG. 12, a lower portion of one side of a front of the frame 140 may be provided with a mount 148 to which a knob 1800 may be rotatably mounted. A coupling case 1804 may be coupled to the lower portion of the frame 140 by fastening the coupling case 1804 with, for example, a screw. A rear surface of the knob 1800 may be provided with a rotation shaft 1801 that extends rearward. A front end of the rotation shaft 1801 may be coupled to the knob 1800, and a rear end of the rotation shaft 1801 may be coupled with a worm 1802. In addition, a worm gear 1803 may be mounted to or on the rotation bar 155 and coupled to the rotation gears 150. Thereby, the worm gear 1803 and the rotation bar 155 may rotate together.

When the knob 1800 is rotated, the worm 1802 may in turn rotate the worm gear 1803. Thereby, the rotation bar 155 and the rotation gears 150 may simultaneously rotate. The rotation bar 155 may be mounted to or at a front upper surface of the frame 140. In this embodiment, the rotation bar 155 is shown mounted by three pairs of brackets and bearings; however, embodiments are not limited thereto.

Among the brackets, bracket 1805 disposed on the right side may be subjected to force applied according to rotation of the knob 1800. Accordingly, the bracket 1805 may be formed to be larger than the other brackets to securely and rotatably fix the rotation bar 155.

As in the previous embodiment, this embodiment may employ a rack and pinion as the power transmission. As shown in FIG. 13, when the knob 1800 is rotated in a first direction, the worm 1802 may in turn rotate the worm gear 1803, and at the same time, the rotation bar 155 and the rotation gears 150 may rotate. Then, the rotation gears 150, which may be pinion gears, may move the rack 175 of the slider 170 in a forward direction. Thereby, as shown in FIG. 14, the rollers 172 provided to or at the exterior of the slider 170 may rise along the inclined guide groove 132, raising the frame 140. At this time, the guide protrusions 145 inserted into the guide grooves 135 may be guided to move only in the vertical direction as described above, and thus, the frame 140 may vertically rise.

FIG. 14A shows the frame 140 lowered to a lower limit, and FIG. 14B shows the frame 140 raised to an upper limit. The raised frame 140 may be lowered by turning the knob 1800 in a second opposite direction.

The elevation and speed of the frame 140 may be properly adjusted according to a length, inclination angle, and position of the guide grooves 135 and a gear ratio between the gears forming the power transmission and rotation device. In this embodiment, the worm gear cannot rotate the worm due to the nature of the worm and worm gear, and therefore the frame 140 does not move down by gravity when the knob 1800 is not held by a hand. Accordingly, the rotation device of this embodiment including the worm and the worm gear may not only function to rotate the rotation gears 150, but also serve as a stopper that prevents the frame 140 from moving down by gravity.

As apparent from the above description, embodiments disclosed herein provide at least the following advantages.

According to embodiments, a user may easily adjust a height of a shelf with less force by pivoting or rotating a handle, such that a slider may be guided by an inclined guide groove. In addition, according to embodiments, by rotating a handle provided to one side, a shelf may be moved while being horizontally balanced. In addition, according to embodiments, shelves may be vertically moved with food or other items placed thereon. Accordingly, the shelves may be conveniently used.

Embodiments disclosed herein provide a refrigerator having a shelf assembly that allows a user to easily adjust a height of shelves by applying less force.

Embodiments disclosed herein provide a refrigerator that may include a cabinet provided therein with a storage compartment, and a shelf assembly mounted to the storage compartment, the shelf assembly being configured to adjust a height of a shelf. The shelf assembly may include a frame mounted to be vertically movable in the storage compartment, a shelf supported by the frame and configured to vertically move, a pair of rotation gears provided to or at opposite sides of the frame, a pair of guide brackets provided to or at the opposite sides of the frame, a pair of sliders moved back and forth within the pair of guide brackets by the pair of rotation gears, an exterior of each of the sliders being provided with at least one pair of protrusions, a power transmission unit or power transmission configured to transmit rotatory power of the rotation gears to the sliders to horizontally move the sliders, at least one pair of guide grooves slantly formed on an inner surface of the storage compartment to guide movement of the at least one pair of protrusions, and a rotation device configured to rotate the pair of rotation gears.

The at least one pair of protrusions may include rollers rotatably mounted to an exterior of each of the sliders. The rotation gears may include a drive gear disposed at a front of the guide brackets and a driven gear disposed at a back of the guide brackets. The power transmission unit may be a belt coupled between the drive gear and the driven gear, an inner circumferential surface of the belt being provided with teeth.

The rotation gears may be pinions. The power transmission unit may be racks formed at one side of each of the sliders, the rack being engaged with and driven by the pinions.

The rotation device may include a rotation bar laterally arranged to or at a front of the frame to rotate together with the pair of rotation gears, a unidirectional rotation gear mounted to the rotation bar, and a handle pivotably mounted to the frame, a rear end of the handle being provided with an arc-shaped gear engaged with the unidirectional rotation gear to rotate the unidirectional rotation gear. The handle may be pivotably mounted to a front side of the unidirectional rotation gear at the frame, and a front end of the handle may extend forward. The unidirectional rotation gear may include a clutch bearing disposed between the unidirectional rotation gear and the rotation bar.

The refrigerator may further include an elastic member installed between the handle and the frame to return the handle to an original position of the handle. The refrigerator may also include a stopper gear mounted to one side of the rotation bar to rotate together with the rotation bar, and a lever pivotably mounted to one side of the frame to be engaged with the stopper gear to prevent the stopper gear from rotating in one direction. One end of the lever may be provided with a locking protrusion selectively engaged with the stopper gear. When the stopper gear is engaged with the locking protrusion, the stopper gear may be supported such that the stopper gear does not rotate in the one direction, but is rotatable in the other direction.

The handle may be pivotably mounted to a front side of the unidirectional rotation gear at the frame. A cutaway part having a shape corresponding to a front end of a pivot shaft of the handle may be provided to or at one side of a front of the shelf, and a front end of the handle may not protrude from a front end of the shelf.

The handle may include a rotation shaft rotatably mounted to a lower portion of the frame, a knob coupled to a front end of the rotation shaft, and a worm coupled to a rear end of the rotation shaft. One side of a rotation shaft of each of the rotation gears may be provided with a worm gear rotated by being engaged with the worm.

Both side parts of the frame may be provided with a guide protrusion. Both inner side surfaces of the storage compartment may be provided with a guide groove vertically formed to allow the guide protrusion to be slidably inserted thereinto, the guide groove guiding vertical movement of the frame.

Embodiments disclosed herein further provide a refrigerator that may include a cabinet provided therein with a storage compartment, and a shelf assembly mounted to the storage compartment, the shelf assembly being configured to adjust a height of a shelf. The shelf assembly may include a case having an open front and an open top, a frame mounted to be vertically movable in the case, a shelf supported by the frame and configured to vertically move, a handle rotatably mounted to one side of a front of the frame, at least one pair of rotation gears provided to opposite sides of the frame, the rotation gears being rotated by operation of the handle, a pair of guide brackets provided to the opposite sides of the frame, a pair of sliders moved back and forth within the pair of guide brackets by the pair of rotation gears, a power transmission unit or power transmission configured to transmit rotatory power of the rotation gears to the sliders to horizontally move the sliders, and at least one pair of guide grooves slantly formed on an inner surface of the case to guide movement of rollers protruding from an exterior of the pair of sliders.

The rotation gears may be pinions, and the power transmission unit may be racks formed at one side of each of the sliders, the racks being engaged with and driven by the pinions. The rotation gears may be connected to each other and rotated together by a rotation bar rotatably mounted to a front of the frame in a lateral direction.

The handle may include a rotation shaft rotatably mounted to a lower portion of the frame, a knob coupled to a front end of the rotation shaft, and a worm coupled to a rear end of the rotation shaft. One side of a rotation shaft of each of the rotation gears may be provided with a worm gear rotated by being engaged with the worm.

Both side parts of the frame may be provided with a guide protrusion. Both inner side surfaces of the storage compartment may be provided with a guide groove vertically formed to allow the guide protrusion to be slidably inserted thereinto, the guide groove guiding vertical movement of the frame.

It will be apparent to those skilled in the art that various modifications and variations can be made in the present invention without departing from the spirit or scope of the inventions. Thus, it is intended that embodiments covers modifications and variations provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet provided therein having a storage compartment; and a shelf assembly mounted in the storage compartment, the shelf assembly being configured to adjust a height of a shelf, wherein the shelf assembly includes:

frame mounted to be vertically movable in the storage compartment;

the shelf, which is supported by the frame and configured to vertically move with the frame;

a pair of rotation gears provided at each of opposite sides of the frame;

a pair of guide brackets provided at the opposite sides of the frame;

a pair of sliders moved back and forth within the pair of guide brackets by the pair of rotation gears, an exterior of each of the pair of sliders being provided with at least one protrusion;

a power transmission configured to transmit rotatory power of the pair of rotation gears to the pair of sliders to horizontally move the pair of sliders;

at least one first guide groove formed on each of opposite inner surfaces of the storage compartment or a case of the shelf assembly to guide movement of the protrusions, the first guide groove being slanted with respect to a horizontal plane; and a rotation device configured to rotate the pair of rotation gears, wherein the rotation device includes:

a rotation bar laterally arranged on the frame to rotate together with the pair of rotation gears:

a unidirectional rotation gear mounted to the rotation bar: and a handle pivotably mounted to the frame, wherein the handle include an arc-shaped gear engaged with the unidirectional rotation gear to rotate the unidirectional rotation gear.

2. The refrigerator according to claim 1, wherein the at least one protrusion includes a pair of rollers rotatably mounted to the exterior of each of the pair of sliders.

3. The refrigerator according to claim 1, wherein the pair of rotation gears includes a drive gear provided at a front of each the pair of guide brackets and a driven gear provide at a rear of each of the pair of guide brackets, and wherein the power transmission includes a belt coupled between the drive gear and the driven gear.

4. The refrigerator according to claim 3, wherein an inner circumferential surface of the belt is provided with teeth.

5. The refrigerator according to claim 1, wherein the pair of rotation gears includes pinions, and wherein the power transmission is a rack formed at a side of each of the pair of sliders, the rack being engaged with and driven by the pinions.

6. The refrigerator according to claim 1, wherein the handle, is pivotably mounted to the unidirectional rotation gear, and wherein a front end of the handle extends in a forward direction.

7. The refrigerator according to claim 6, wherein the unidirectional rotation gear includes a clutch bearing provided between the unidirectional rotation gear and the rotation bar.

8. The refrigerator according to claim 7, further including an elastic member installed between the handle and the frame to return the handle to an original position of the handle.

9. The refrigerator according to claim 1, further including:

a stopper gear mounted on the rotation bar to rotate together with the rotation bar; and a lever pivotably mounted to the frame and engaged with the stopper gear to prevent the stopper gear from rowing in a first direction.

10. The refrigerator according to claim 9, wherein an end of the lever is provided with a locking protrusion selectively engaged with the stopper gear, and wherein when the stopper gear is engaged with the locking protrusion, the stopper gear is supported such that the stopper gear does not rotate in the. first direction, but is rotatable in a second direction.

11. The refrigerator according to claim 1, wherein the handle is pivotably mounted to the unidirectional rotation gear, wherein a cutaway having a shape corresponding to a front end of the handle is provided at one side of a front of the shelf, and wherein a front end of the handle does not protrude from a front end of the shelf.

12. The refrigerator according to claim 1, wherein each of the opposite sides of the frame are provided with at least one guide protrusion, wherein each of the opposite inner side surfaces of the storage compartment or the case of the shelf assembly are provided with at least one second guide groove vertically formed to allow the at least one guide protrusion to be slidably inserted thereinto, and wherein the second guide grooves guide vertical movement of the frame.

13. The refrigerator according to claim 1, wherein the frame includes a concave portion having an open top.

14. The refrigerator according to claim 13, wherein the pair of rotation gears, the pair of guide brackets, the pair of sliders, the power transmission, and the rotation device are mounted to the concave portion of the frame.

15. The refrigerator according to claim 14, further including a frame cover that covers the open top of the frame.

16. The refrigerator according to claim 15, wherein the frame cover has a shape corresponding to a shape of the concave portion of the frame.

17. The refrigerator according to claim. 15, wherein a portion of the frame cover that overlaps the pair of rotation gears and the rotation device includes a plurality of grooves such that the frame cover does not interfere with the pair of rotation gears and the rotation device.

18. A shelf assembly, comprising:

a case having an open front and an open top;

a frame mounted to b vertically movable m the case;

a shelf supported by the frame and configured to vertically move with the frame;

a pair of rotation gears provided at each of opposite sides of the frame;

a pair of guide brackets provided at the opposite sides of the frame;

a pair of sliders moved back and forth within the pair of guide brackets by the pair of rotation gears;

a power transmission configured to transmit rotatory power of the pair of rotation gears to the pair of sliders to horizontally move the pair of sliders, wherein the pair of rotation gears includes plurality of pinions, and wherein the power transmission is a rack formed at a side of each of the pair of sliders, the rack being engaged with and driven by the plurality of pinions, and wherein the pair of rotation gears is connected to each other and rotated together by a rotation bar rotatably mounted at a front of the frame in a lateral direction;

at least one first guide groove formed on each of opposite inner surfaces of the case to guide movement of rollers that protrude from an exterior of the pair of sliders; and a handle rotatably mounted to the frame, wherein the pair of rotation gears is rotated by operation of the handle, wherein the handle includes a rotation shaft rotatably mounted to the frame, a knob coupled to the rotation shaft, and a worm coupled to the rotation shaft, wherein a worm gear is mounted adjacent one of the pair of rotation gears, and wherein the worm gear is rotated by being engaged with the worm.

19. The shelf assembly according to claim 18, wherein each of the opposite side surfaces of the frame are provided with at least one guide protrusion, wherein each of inner side surfaces of the case are provided with at least one second guide groove vertically formed to allow the at least one guide protrusion to be slidably inserted thereinto, and wherein the second guide grooves guide vertical movement of the frame.

20. The shelf assembly according to claim 18, wherein the pair of rotation gear includes a drive gear provided at a front of each of the pair of guide brackets and a driven gear provided at a rear of each of the pair of guide brackets, and wherein the power transmission includes a belt coupled between the drive gear and the driven gear.

* * * * *